US006351898B1

(12) United States Patent
Lewis et al.

(10) Patent No.: US 6,351,898 B1
(45) Date of Patent: Mar. 5, 2002

(54) HEIGHT ADJUSTMENT SYSTEM

(76) Inventors: Scott Lewis, 492 S. Youngfield Ct., Lakewood, CO (US) 80228; Mike Weege, 4872 S. Cedar Rd., Evergreen, CO (US) 80439; Greg Noah, 21164 E. Scott Pl., Denver, CO (US) 80249

( * ) Notice: Subject to any disclaimer, the term of this patent is extended or adjusted under 35 U.S.C. 154(b) by 0 days.

(21) Appl. No.: 09/840,417

(22) Filed: Apr. 23, 2001

Related U.S. Application Data

(60) Provisional application No. 60/199,053, filed on Apr. 22, 2000.

(51) Int. Cl.[7] ..... E02F 3/00

(52) U.S. Cl. ..... 37/197; 37/232; 37/271; 37/195; 37/466

(58) Field of Search ..... 37/271, 270, 266, 37/196, 197, 232, 466, 195; 15/159.1, 184, 21.1, 54, 78, 93.3, 93.1

(56) References Cited

U.S. PATENT DOCUMENTS 4,560,931 A * 12/1985 Murakami et al. ..... 324/220

5,363,937 A * 11/1994 James ..... 180/192

* cited by examiner

*Primary Examiner*—Christopher J. Novosad

(74) *Attorney, Agent, or Firm*—Jenkens & Gilchrist

(57) ABSTRACT

The invention relates to an apparatus and method for utilization of a proximity sensor to control the height adjustment of vehicle-mounted devices for use in clearing snow or debris from a road or runway. One end of a shaft is connected to the broom, while the other end is mounted on top of the broom assembly. A threaded collar on the shaft moves axially in response to change in the height of the broom assembly. A proximity sensor produces and monitors a magnetic field near the central portion of the shaft. Height adjustment of the broom causes the collar to move past the proximity sensor, thereby distorting the magnetic field. The proximity sensor stops the electrical signal which controls the downward movement of the broom assembly. The height selection for the broom assembly is adjusted by turning a nut or ratchet assembly on the end of the shaft.

11 Claims, 2 Drawing Sheets

HEIGHT ADJUSTMENT SYSTEM

This application claims the benefit under Title 35 United States Code §119(e) of U.S. Provisional Application No. 60/199,053, filed Apr. 22, 2000.

BACKGROUND OF THE INVENTION

1. Technical Field

This invention relates generally to methods and apparatus for controlling the height adjustment of vehicle-mounted devices for use in clearing snow or debris from a road or runway. More particularly, this invention relates to an apparatus and method for utilization of a proximity sensor to control the height adjustment of vehicle-mounted devices for use in clearing snow or debris from a road or runway.

2. History of Related Art

In vehicle-mounted devices for use in clearing snow or debris from a road or runway, the vertical position of the spinning broom assembly determines the amount of contact between the broom bristles and the surface of the road or runway. In prior art systems, the vertical position of the spinning broom assembly is accomplished by the use of a mechanical stop located under the broom assembly. Thus, when the operator wants to change the vertical position of the broom bristles with respect to the surface of the road or runway, it is necessary for the operator to crawl under the broom assembly in the snow or debris and physically adjust the position of the mechanical stop.

The brooms typically found on the front of a truck include a plurality of bristle assemblies which engage a rotating broom core. These bristle assemblies are mounted on a core assembly which is driven by a variety of different drive systems. The broom bristles are made of steel wire which gradually wear down from use. The contact area or "pattern" formed by the end of the bristles and the runway surface should be between 2"–6" wide depending upon snow conditions for effective snow or debris removal. As the bristles wear down, the pattern width decreases. Accordingly, the broom must be repositioned vertically to maintain the desired pattern width.

The brooms typically have an operational life of about 60 hours, at which time the bristles are effectively worn down to their mountings. Thus, there is an ongoing requirement for height adjustment of the broom assembly as the broom bristles wear or become shorter. The relatively inaccessible location under the broom of the mechanical system for adjusting the sweep pattern makes the ongoing vertical repositioning problematic. What is needed is a mechanism for controlling the height adjustment of the broom assembly which is sensitive to changes in the position of the broom and easily accessible to the operator.

SUMMARY OF THE INVENTION

The present invention is an apparatus and method for utilization of a proximity sensor to control the height adjustment of vehicle-mounted devices for use in clearing snow or debris from a road or runway. To make the adjustment of the vertical height of the broom more convenient, the control mechanism which senses and controls the height of the broom has been moved from underneath the broom to the top of the broom.

A shaft and proximity sensor are located on the top of the broom assembly to indicate the vertical position of the broom. One end of the shaft is mounted on the broom, while the other end is attached to a ratchet assembly. A threadable collar is located on the central portion of the shaft. The rod and collar move past the proximity sensor when the broom height changes.

The proximity sensor produces and monitors a magnetic field. When the collar moves past the proximity sensor, it distorts the magnetic field and causes the proximity sensor to stop the electrical signal to the valve controlling the height of the broom. The broom height control mechanism is adjusted by the ratchet assembly which tightens a nut on the end of the threaded portion of the shaft which changes the position of the collar on the shaft.

BRIEF DESCRIPTION OF THE DRAWING FIGURES

A more complete understanding of the structure and operation of the present invention may be had by reference to the following detailed description when read in conjunction with the accompanying Drawing Figures, wherein.

DETAILED DESCRIPTION OF THE PRESENTLY PREFERRED EXEMPLARY EMBODIMENT

Figure 1:
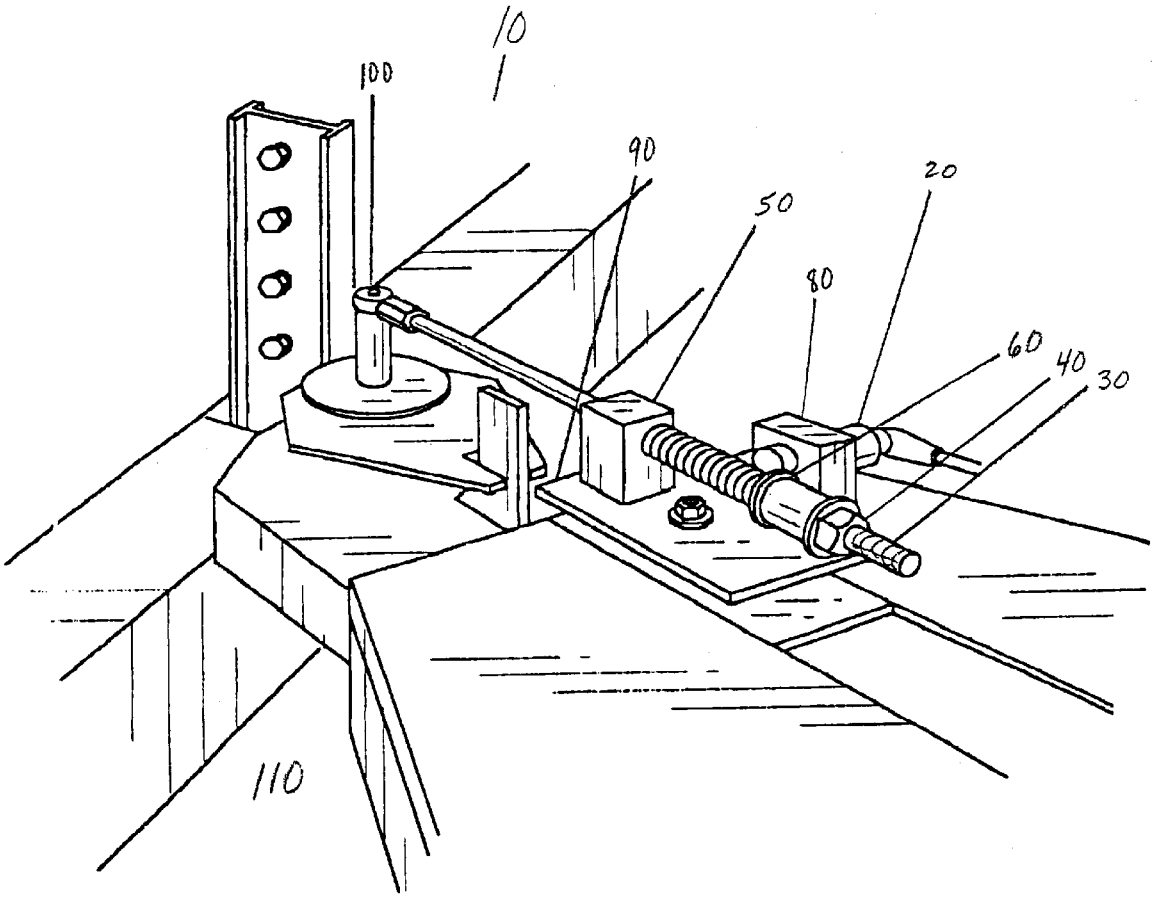
FIG. 1 is an anterior perspective view of the proximity sensor assembly of the present invention.

A still better understanding of the apparatus and method for utilization of a proximity sensor to control the height adjustment of vehicle-mounted devices for use in clearing snow or debris from a road or runway of the present invention may be had by reference to the Drawing Figures. FIG. 1 is an anterior perspective view of the proximity sensor assembly 10 of the present invention. The proximity sensor assembly 10 is located on top of the broom assembly 110 rather than underneath the broom as in the prior art.

The proximity sensor 20 is positioned in a proximity sensor mount 80 which is attached to the height control plate 90. A height control shaft 30 is attached at a rod end female stud 100 to the broom assembly 110. From the rod end female stud 100, the height control shaft 30 extends through a shaft bushing block 50 past the proximity sensor 20. At the distal end of the height control shaft 30, a threadable collar 60 is threadably attached to the height control shaft 30. A nut 40 is located at the end of the threadable collar 60 on the threaded end of the height control shaft 30. The position of the collar 60 on the shaft 30 is correlated to the pattern of the broom bristles on the pavement by positioning the nut 40.

The broom assembly 110 height is adjusted by turning the nut 40 on the threaded end of the shaft 30. As the broom assembly 110 height changes, the height control shaft 30 and threadable collar 60 move past the proximity sensor 20. The proximity sensor 20 produces and monitors a magnetic field. When the threadable collar 60 moves past the proximity sensor 20, it distorts the magnetic field and causes the proximity sensor 20 to stop the electrical signal to the valve controlling the height of the broom assembly 110.

Figure 2:
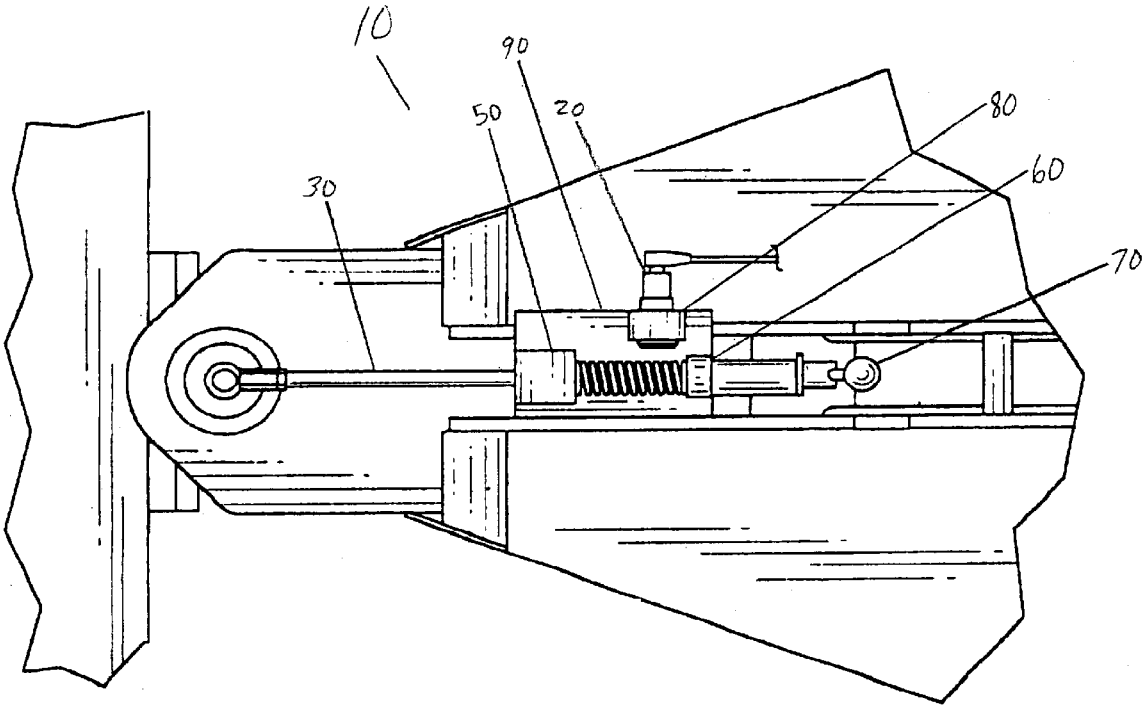
FIG. 2 is a top view of the proximity sensor assembly of the present invention.
Figure 3:
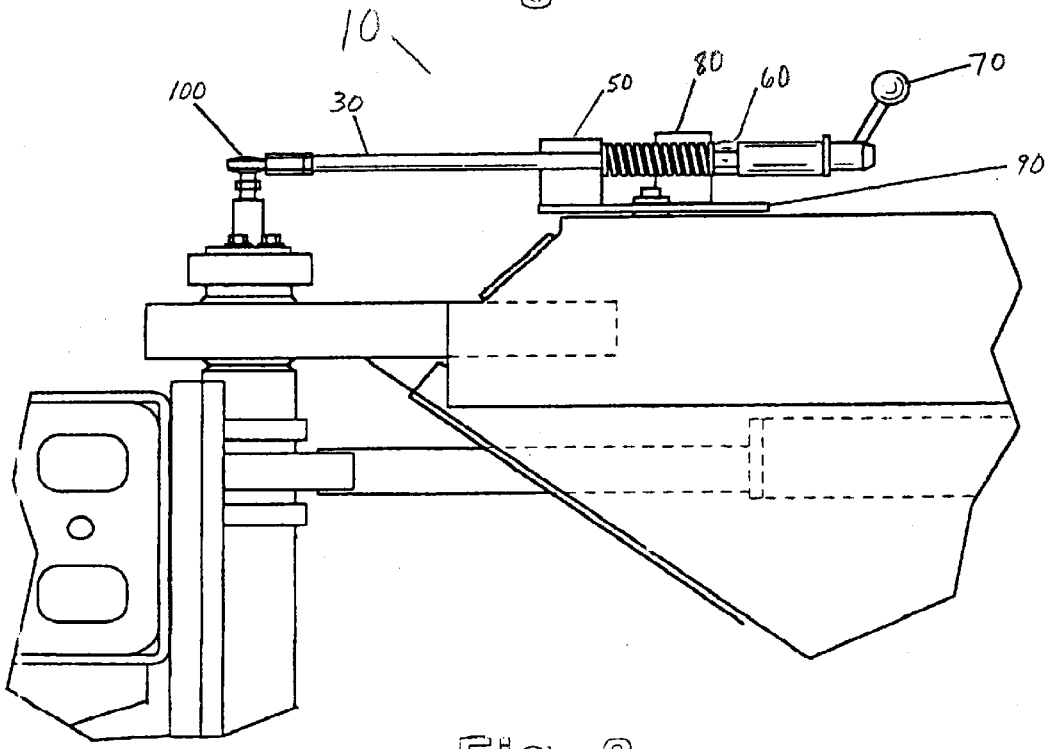
FIG. 3 is a lateral view of the proximity sensor with ratchet assembly of the present invention.

FIGS. 2 and 3 are top and lateral views respectively, of the proximity sensor assembly 10 of the present invention. The broom height adjustment mechanism in FIGS. 2 and 3 illustrates a ratchet assembly 70 located at the end of the threaded height control shaft 30. The ratchet assembly 70 can be used instead of the nut 40 which is shown in FIG. 1. Broom height adjustment in this embodiment is made by turning the ratchet assembly 70 located at the end of the height control shaft 30 rather than by tightening the nut 40 shown in FIG. 1. The ratchet assembly 70 is turned on the threaded height control shaft 30, thereby moving the threaded collar 60 past the proximity sensor 20. As noted above, the movement of the threadable collar 60 past the proximity sensor 20 distorts the magnetic field and causes the proximity sensor 20 to stop the electrical signal to the valve controlling the downward movement of the broom assembly 110. Other proximity sensors known to those of ordinary skill in the art may also be utilized.

Although the invention has been described with reference to its preferred embodiment, this description is not meant to be construed in a limited sense. Various modifications of the disclosed embodiment, as well as alternative embodiments of the invention, will become apparent to persons skilled in the art upon reference to the description of the invention. It is, therefore, contemplated that the appended claims will cover such modifications that fall within the scope of the invention, or their equivalents.

What is claimed is:

1. A height adjustment control system for a vehicle designed to remove unwanted materials from a road or a runway comprising:

means for removing unwanted materials from a road or runway constructed and arranged to be mounted to the vehicle;

means for moving said means for removing unwanted materials from a road or runway with respect to the surface of the road or the runway;

an electrical signal to the means for moving said means for removing unwanted materials from a road or runway with respect to the surface of the road or the runway;

a shaft having a first end, a second end and a central portion;

said first end of said shaft connected to said means for removing unwanted materials from the road or the runway;

a ratchet assembly threadably connected to said second end of said shaft;

a threadable collar movably attached to said central portion of said shaft;

a proximity sensor constructed and arranged to produce and monitor a magnetic field adjacent to said central portion of said shaft;

whereby the position of said means for removing unwanted materials with respect to the surface of the road or the runway as caused by said means for moving may be set by the position of said ratchet assembly on said second end of said shaft; and whereby the movement of said shaft moves said threadable collar past said proximity sensor, thereby distorting said magnetic field, and stopping said electrical signal to said means for moving said means for removing unwanted materials from the road or the runway.

2. The height adjustment control system as defined in claim 1 further including means for supporting and axially guiding the movement of said shaft in response to the position of the means for removing unwanted materials from the road or roadway.

3. The height adjustment control system as defined in claim 1 wherein said means for supporting and axially guiding the movement of said shaft is a bushing block.

4. The height adjustment control system as defined in claim 1 wherein said means for removing unwanted materials from a road or a runway is a broom.

5. The height adjustment control system as defined in claim 1 wherein said means for removing unwanted materials from a road or a runway is a plow.

6. A system for indicating the height of a vehicle mounted broom or plow, said system comprising:

a shaft having a first end, an externally threaded second end and a central portion therebetween;

said first end of said shaft being rotatably mounted to the broom or plow;

an internally threaded collar threadably attached to said central portion of said shaft;

means for producing and monitoring a magnetic field;

means for producing and monitoring a magnetic field indicative of the position of said internally threaded collar;

means for producing an electrical signal to said vehicle mounted broom or plow;

whereby as the broom or plow is moved, said shaft is caused to move axially, which in turn causes said internally threaded collar to move past said means for producing and monitoring a magnetic field, thereby distorting said magnetic field and stopping the electrical signal to said vehicle mounted broom or plow.

7. The system as defined in claim 6 further including means for supporting and guiding the axial movement of said shaft in response to the positioning of the broom or plow.

8. The system as defined in claim 7 wherein said means for supporting and guiding the axial movement of said shaft is a bushing block.

9. The system as defined in claim 6 wherein said means for producing and monitoring a magnetic field indicative of the position of said internally threaded collar is a proximity sensor.

10. A method for indicating the position of a vehicle mounted broom or plow, said method comprising the steps of:

connecting the first end of a shaft to the broom or plow; supporting and guiding the motion of the central portion of said shaft in response to the position of the broom or plow;

attaching a movable collar to the central portion of said shaft;

producing and monitoring a magnetic field in response to the position of said shaft; whereby the position of the broom or plow may be determined from the presence or absence of said electrical signal.

11. A method for indicating the position of a vehicle mounted broom or plow, said method comprising the steps of:

connecting the first end of a shaft to the broom or plow; supporting and guiding the motion of the central portion of said shaft in response to the position of the broom or plow;

attaching a movable collar to the central portion of said shaft;

producing an electrical signal in response to the position of said shaft;

whereby the position of the broom or plow may be determined from the presence or absence of said electrical signal.

* * * * *